US005870884A

United States Patent [19]

Pike

[11] Patent Number: 5,870,884

[45] Date of Patent: Feb. 16, 1999

[54] COMPARTMENTED PACKAGE WITH MULTISTAGE PERMEATION BARRIER

[76] Inventor: Brian R Pike, 2515-1 Pioneer Ave., Vista, Calif. 92083

[21] Appl. No.: 677,510

[22] Filed: Jul. 10, 1996

[51] Int. Cl.[6] ..... B65B 9/02; B65B 9/20; B65B 43/06

[52] U.S. Cl. ..... 53/410; 53/451; 53/474; 53/554; 53/374.2; 493/391; 493/931; 156/205; 156/208; 156/581

[58] Field of Search ..... 53/410, 451, 474, 53/554, 374.2, 374.4; 493/380, 391, 920, 931, 302; 156/197, 205, 208, 210, 292, 581

[56] References Cited

U.S. PATENT DOCUMENTS

| | | | |
|---|---|---|---|
| 2,771,724 | 11/1956 | Hosier et al. | 53/474 X |
| 3,016,806 | 1/1962 | Schoen et al. | 493/931 X |
| 3,608,709 | 9/1971 | Pike | 53/474 X |
| 3,690,981 | 9/1972 | Frank et al. | 156/208 X |
| 3,859,159 | 1/1975 | Carter et al. | 156/581 |
| 3,940,905 | 3/1976 | Perry, III | 53/474 X |
| 4,495,748 | 1/1985 | Rowell | 493/931 X |
| 4,603,540 | 8/1986 | Kopp | 53/554 X |
| 4,708,757 | 11/1987 | Guthrie | 156/210 X |
| 4,876,134 | 10/1989 | Saitoh et al. | 156/197 X |
| 4,995,217 | 2/1991 | Francis, Jr. | 53/474 X |

*Primary Examiner*—Horace M. Culver
*Attorney, Agent, or Firm*—Fitch, Even, Tabin & Flannery

[57] ABSTRACT

A multiple compartment package having a connecting bridge with a frangible internal barrier is made from two composite or thermoplastic sheets or webs welded together to form the front and back walls of the package, and the central bridge portion is defined by one or more partitions spanning the short distance between the webs. In the preferred embodiment, multiple partitions form a plurality of parallel compartment strips to create an obstruction to penetration of substances from one packet to the other. One process for making the invention uses a comb-shaped mask and a thermoplastic insert strip interwoven between the tines of the comb. The tines are extended down between the welding heads of the packaging machine, preventing welding from taking place between the thermoplastic sheets wherever the comb mash is, with the result that the welding occurs between the strip and an alternating one of the side webs creating a zig-zag pattern that forms the vacant barrier compartments. In a significant modification, this physical mask is replaced by mask coatings printed onto both sides of the strip, or printed on the webs rather than the strip, to cause the same localized compartment-forming welding failure as the physical comb mask. The perimeter seal of a single or multiple package can be provided with a preferred rupture point using the same techniques.

16 Claims, 2 Drawing Sheets

COMPARTMENTED PACKAGE WITH MULTISTAGE PERMEATION BARRIER

BACKGROUND OF THE INVENTION

The invention relates to envelope-type packages of the kind that became widely known from "smoked almond" inflight snacks on the airlines in the sixties, formed from foil, paper and plastic. A continuous sheet of this laminate with at least one surface being a thermoplastic layer is folded over onto itself about the longitudinal centerline with the thermoplastic inside, and the overlaid side edges are welded together to form a seam. The endless tube thus formed is then heat-sealed laterally to define the bottom of an individual package, which is filled with nuts, then sealed across the top, and finally cut from the continuous band as an individual bag.

Multiple-compartment packages are produced the same way but with an added longitudinal seam parallel to the side edge seams creating a welded bridge between adjacent packets. Since the purpose of multiple compartments is to permit mixing the ingredients without opening the bag, the bridge must have a frangible or separable internal barrier.

Multiple compartment mixing packages of this type are used with products containing volatile or chemically active elements which must be separated from one another until just prior to use, such as certain adhesives, cosmetics, and even foods. In addition to all the requirements demanded of single-produce packages, these multiple compartment packages must address the problem of producing a reliable yet frangible connection that will not permit seepage from one packet to the next, and will not separate during rough handling, yet will repeatedly and reliably fail before the perimeter seals give way when the packets are squeezed.

Early approaches to the bridge problem are typified by the instant inventor's earlier patents, and various other techniques initiating the use of dissimilar resins such as low density polyethylene and ionomer resin, with carefully controlled welding conditions, in an attempt to produce a peelable weld. Also, printed blocks of peelable coatings or fibrous material such as paper have been used as welding inhibitors in the dividing weld of a multiple compartment package. Such peelable coatings have not typically produced reliable and rugged enough frangible seals to survive the rigors of commercial distribution A better approach has been the full-strength weld across an inter-laminate weakened area. See U.S. Pat. No. 3,608,709, issued Sep. 28, 1971. Typically such packages have to be made utilizing printing presses which can print a block of resist on one side of the package web in register with the graphics on the opposite side. Such two-side register printing presses are available but not common. In the known art, when a package web is thus printed in register on two sides, a secondary step is required wherein the entire inner surface of the web is extrusion-coated with a thermoplastic layer, trapping the resist block between the two layers of plastic. Because the resist prevents welding between two adjacent layers of thermoplastic, and because the overall extruded plastic coating welds in all other areas to the inner web surface, this process results in the manufacture of a package web with an inter-laminate weakened area at the resist block. Subsequently, the inter-laminate weakened area would only have the strength of the final extrusion coating rather than the combined strength of all of the layers of the composite, as detailed in the above-referenced patent. This process, while effective, required highly specialized manufacturing equipment and is only cost effective if done in very high quantities.

Another known method is to pre-print a resist block on a narrow thin web of thermoplastic and introduce this into the packaging machine. When such blocks are first printed on a narrow thermoplastic strip as is known in the art, and that strip is inserted into a form-fill-seal machine, it requires that the thermoplastic strip be continuously adjusted mechanically to longitudinally register the constant-feed webs forming the package walls with the merging resist strip, to ensure that the resist blocks at no point extend beyond the perimeter seal of the package. If the resist block is too long, it projects through the perimeter seal and creates a leakage path for the contents when the package is used. If too short, it produces a rectangular seal with sharp right angels when the frangible seal is broken. These right angle projections are points of weakness that often cause rupture of the package material and leakage of its contents. The proper dimension for the resist block is to extend up to, but not enter, the transverse heat seal region of the package. As these seals are typically on the order of 0.25 inch wide, this requires very close registration of the thermoplastic web which is often beyond the ability of commercial packaging equipment.

Since a resist block prevents welding, as opposed to the technique of incorporating an interlaminate peelable layer, there is an additional requirement that the resist block strip itself be welded around its perimeter to one package wall, in register with the package graphics on the opposite side of that package wall. Few packaging machines are capable of accomplishing these tasks. Thus one prior solution has been to process the package web offline with yet another machine to properly and precisely weld the thermoplastic frangible web to the package web. This additional process step and machinery adds substantial cost to the package.

The commonly used trade term, "shelf stability", describes the period of time it takes a product to deteriorate to commercial unacceptability. With some products, if the only barrier between separated elements is a thin thermoplastic layer, migration across the barrier is relatively rapid and predictable and results in low shelf stability. It is known in the art as represented in the inventor's U.S. Pat. No. 4,402,4402, issued Oct. 14, 1981, that substantial improvement in shelf stability can be obtained without changing the packaging materials, by separating active ingredients with multiple empty compartments rather than a single weld line. Spaced welds across the bridge area can be used to create miniature, empty versions of the product-containing packets, which lie as an obstacle course to migratory chemicals without substantially increasing the force necessary to rupture the barrier, since the compartments are ruptured sequentially as one of the packets is squeezed. This known technique, however, incurs a penalty in size and cost by forcing the addition of seal bars and associated mechanisms to the packaging machine. A considerably larger package is produced, with greater material cost, to accommodate the consecutive empty compartments.

SUMMARY

These problems and others are solved by the present invention as will be described. The preferred method of the invention utilizes mechanical masks on a form-fill-seal packaging machine. Two-part mechanical masks of a thin material (0.006–010 inch) have alternating tines which extend downstream between package sidewall webs from a fixed location on the packaging machine to cover selected parts of each of the wall webs. A continuous, narrow thermoplastic strip is fed between the mask parts, resulting in the strip becoming interwoven with the tines, and is thereby positioned to weld alternately to each package sidewall. The thermoplastic strip is made from a polymer that welds to the innermost thermoplastic layer of each outer package wall. Heat seal bars of the appropriate geometry close on the combination of the outer package walls, the masks, and the inner thermoplastic strip.

This process yields a series of partitions created from parallel welds of the strip that alternate from one package wall to the other, forming a frangible barrier seal between compartments. The thin (0.0005–0.003) thermoplastic web which becomes the frangible seal in the heat seal mechanism of the form-fill-seal machine requires no provision for mechanically registering a print pattern with the package being made.

In addition, to further improve the barrier properties of the frangible seal, this thermoplastic web can itself be made from a combination of different plastic layers which are hand-picked for various qualities and co-extruded as a single sheet. Such a co-extrusion might have a central barrier resin such as polypropylene or saran, and two or more outer film layers such as EVA or low density polyethylene on each surface to improve weldability to the polyethylene layer typically used for the inner surface of this type of laminated package.

Product filling can take place simultaneously to the formation of the frangible seal, or subsequent to its formation, depending on the particular machine employed. The process can be used with either reciprocating, intermittent motion machines or continuous motion rotary machines, either horizontal or vertical format, but the preferred type is an intermittent motion vertical machine. The process can likewise be used to manufacture empty bags, open on each end, which can later be filled with product and sealed. The number, size, and shape of the package compartments separated by frangible seals can be tailored to the product being packaged. The outer package walls can be made from any of the composite films, foils, plastic, and paper materials in commercial use.

An important feature of the principal embodiment is that it requires no additional manufacturing step to prepare the outer package material. A manufacturer who has qualified a particular packaging material for a specific product may continue to use it without change.

Also, unlike prior art processes, this process does not add potentially contaminating or adulterating substances to the product being packaged, such as resist agents or other printing. In the prior art, the printed resist material was exposed to the package contents when the package was used, and would contaminate certain medical products to the point of unacceptability.

In earlier processes, it was often necessary to cover the entire surface of at least one of the package walls with an additional layer of plastic to achieve a reliable frangible seal. Thus, many times the amount of plastic sheeting required to actually create the seal was used, compared to the narrow strip of material used in this invention. This results in a material saving that in turn allows the use of more exotic ply schedules.

In a variation, printed resist material is used in place of the physical mask. In this case, the printing process is employed to take advantage of its inherent precision. A mask of a suitable resist coating is printed on one surface of the outer package wall, comprising a series of thin rectangular blocks. A similar pattern is shifted to overlap the first, and printed on the opposite package wall. When the two package walls are superimposed, the gaps between the rectangular blocks printed on one wall align with the center of the rectangular blocks printed on the opposite wall. Thus if an unprinted thermoplastic strip is positioned between these two walls, and sealed with a seal bar of appropriate dimension, the thermoplastic strip will be selectively sealed to both package walls in much the same way as the mechanical masks previously described. The advantage of the printing step, however, is that physical size of the masks can be substantially reduced. Thus, in a seal only one-quarter inch wide, it would be possible to have five separate seal bands of 0.025–0.030 width. Moreover, there is now no requirement to notch or otherwise change the welding surface of the seal bars to accommodate the extra thickness of a mechanical mask. Nevertheless, due to the fact that multiple parallel welds are being made first to one package wall, then to the other, the high barrier properties of the frangible seal will be retained, in spite of the reduction in size.

A printed bar of resist comprised of a series of dots feathering out to the edges with increasingly smaller dots at the same pitch, has proven to be an advantageous configuration of the printing in the second embodiment.

DETAILED DESCRIPTION OF THE PREFERRED EMBODIMENT

Figure 1:
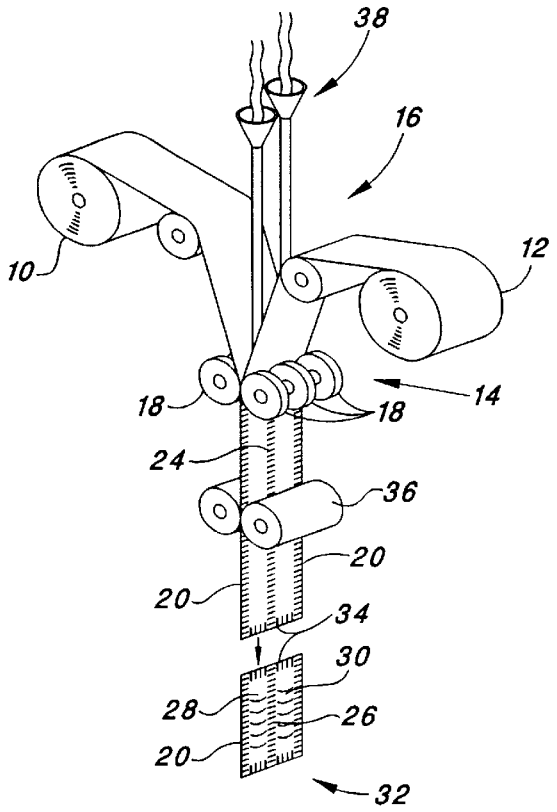
FIG. 1 is a diagrammatic perspective view of a continuous feed rotary head form-fill-seal machine typical in the industry.

A typical prior art dual-packet packaging machine 16 is shown in FIG. 1, taken from the manufacturer's diagram.

Two package webs 10 and 12, which will be the front and back faces of the packages, are fed into the welding portion 14 of the packaging machine 16, where the welding heads 18 create continuous longitudinal welds along the webs' side edges at 20 as well as the vertical mid-line 22. This produces an envelope with a central welded band 24 which will serve as the bridge 26 between the right and left packets 28 and 30 of the final package 32. The transverse seals 34 between consecutive packages in the stream are made by the rotary heads 36 at the location where the transverse cut is subsequently made to produce discrete packages from the stream. At the longitudinal locus representing the phase in the packaging sequence at which the bottom and sides of the envelope have already been sealed, the filing mechanism 38 at the top of the machine deposits measured doses of liquid, pellets, powder or granules, oblivious to the presence or absence of the invention.

If the twin pack is to have a bridge that ruptures into a communication passageway when the packet is squeezed, a substantial discrepancy in bonding strength between the central band and the package edges must be created to ensure that the edge seams do not burst before the bridge area. Either a thin or weak layer of plastic must be added to the center band which breaks before the edge welds, or the welded bond itself must be weakened in the formation process. When the bridge ruptures, in the first approach a membrane is breached, whereas the second relies on delamination of strata at the center band. The packages in this disclosure fall into the first category, having rupturable membranes. Since one of the principal goals of the invention is to produce a multiple compartment package with a known, reliable and repeatable barrier breakdown threshold, the disclosed techniques do not rely on delamination. The required rupturing force for a uniform-thickness, homogeneous-composition membrane is much more stable than the force required to delaminate a partially degraded seam weld, especially after rough handling has worn the weld bond.

Although the invention relies on rupturing rather than delamination, nonetheless interfering with the welding of the center band is the crux of the process. The method of the first embodiment is believed to be completely new to the packaging industry. The process creates packages without either imposing costly additional registration requirements on the packaging equipment, or necessitating prepackaging processing such as the application of resist patches to the package webs or to added thermoplastic layers. Elimination of the requirement that the webs feed in both longitudinal and lateral registry with a preprinted strip results in a substantial simplification in the process and eliminates delay, as well as a degree of uncertainty in package performance inherent in the possibility of registry being slightly off.

Figure 2:
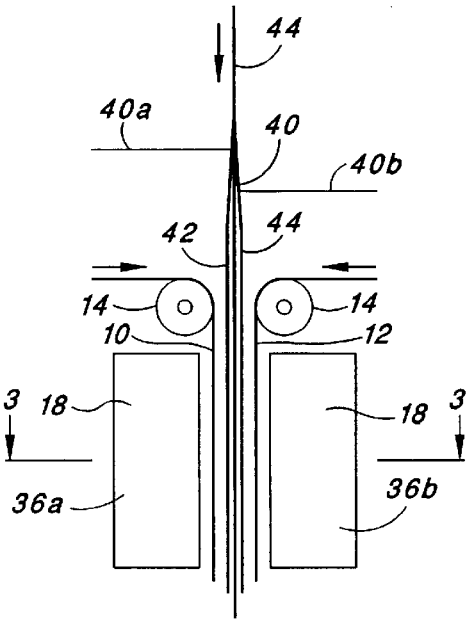
FIG. 2 is a diagrammatic section taken through the welding portion of a reciprocating-type packaging machine (as opposed to the continuous feed rotary machine of FIG. 1) illustrating the mechanical mask of the first embodiment of the invention in place.
Figure 5:
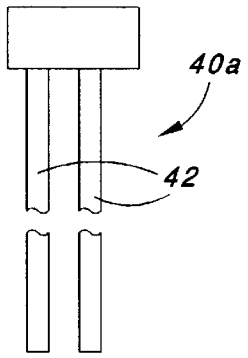
FIG. 5 is a front elevation view of one part of the interdigitated two-part comb-like mask used in FIGS. 2 through 4.
Figure 3:
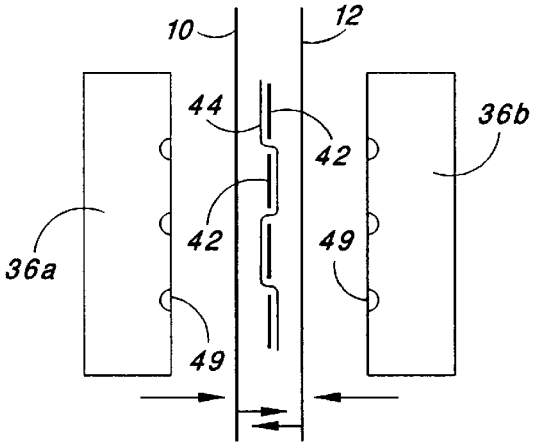
FIG. 3 is a section taken through the same apparatus as FIG. 2 except the section is horizontal when referenced to the machine orientation illustrated in FIG. 2.

Creation of a weakened connecting area without preprocessing or registration requirements is is achieved by avoiding all types of permanent, printed-on chemical resist approaches and relying on mechanical interference with the welding process. As shown in FIG. 2 and also in FIG. 3, a comb-like mask 40 is made of two similar parts 40*a* and 40*b* with interdigitated tines 42 on the order of 0.006 inch thick and 0.120 inch wide. The mask parts can be made of stainless steel or a number of tough materials, with the preferred material currently being Teflon®-coated glass composite. The end tines are wider than the others to allow for manufacturing tolerances, insuring that the strip is overlapped at the side edges to prevent an uncontrolled solid weld.

The comb extends into the packaging machine, down between the welding rollers 14 shown in FIG. 2. The comb remains fixed at this particular longitudinal situs in the machine permanently, or at least for the duration of the run. Mandrel-like, the tines insert between the merging package webs and between the heads of the longitudinal seam welder and completely defeat the weld where they are present. It prevents plastic sheet material separated by tines from bonding under the heat and pressure of the welding rollers.

Longitudinal synchronization is not needed to prevent faulty perimeter welds as in the printed resist processes since the upstream presence of the physical mask does not affect the transverse welders in any way.

Figure 4:
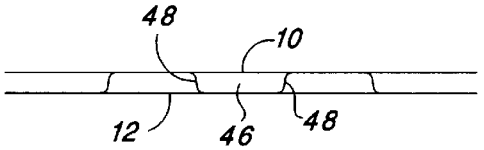
FIG. 4 is a diagrammatic view of a mask with the interwoven strip as it would appear in cross section during the formation processes, together with the pattern of the strip that is produced between the webs shown immediately below.

Woven between the individual tines 42 by being fed between the mask parts is a strip of thermoplastic 44. This strip laterally aligns with, and becomes part of, the central welded band 24 produced by the welding heads. When the strip exits these heads, it is welded alternately, to first one web and then the other forming a barrier 46 as shown in FIG. 4. Because the tines do not overlap, but merely approach very closely to one another, the partitions 48 that the strip becomes do not have long runs spanning between the webs, but rather very short lengths as shown in FIG. 4, so that the two webs 10 and 12 are almost flush against one another. Grooves 49 longitudinally extended in the longitudinal welding heads 36*a* and 36*b* of FIG. 3 assist the formation of actual compartments between barrier partitions by freeing the strip from the webs adjacent the crossover points.

Similar grooves would be produced in the heads 36 of the continuous feed machine to adapt it to this process. But although this description often refers to the continuous feed process for ease of explanation the intermitter process is preferable due to the longer head dwell time and reduced heat.

This technique eliminates all pre-processing. Lateral alignment of the mask, strip and longitudinal welding heads is needed, but no registration is required. The comb extends down through the packaging machine and past the welding heads and remains in position. By interfering with the welding at the welding head area, beyond that area there is no interference and the transverse welders 36 are free to create permanent full-strength welds across the leading and trailing edges for the package.

These advantages and others make the mechanical mask technique very attractive. In the prior art the breachable layer was part of a full-width sheet overlaid and welded to the webs to hold it in place. Because the strip was so wide, it was cost-prohibitive to use the more exotic coextrusions and take advantage of the different qualities inherent in different compositions of different layers. Now, using this process, few coextrusions are eliminated from consideration based on cost.

Figure 7:
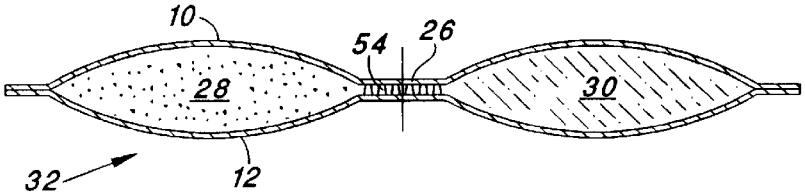
FIG. 7 is a diagrammatic section taken through a multiple compartment package illustrating the bridge of FIG. 6 in place.

The physical mask also lends itself to the formation of multicompartmented barriers and the commensurate beneficial effect on shelf life. Multiple compartment packages such as that shown in FIG. 7 can be produced with the physical mask. However, inasmuch as for strength the physical mask tines must be a certain minimum width, about an eighth of an inch, the number of compartments in a conventional package produced by this method is limited to about two. In the second embodiment of the invention, using a technique inspired by the first, this limitation does not apply.

Accordingly, this second technique also produces multiple consecutive compartments, but does so with chemical masks. Narrow printed bars with center-to-center spacing down to 0.050 inch, can create five barrier compartments in a quarter-inch of bridge run. An additional mechanical registration step is required to properly align the preprinted mask on the thermoplastic strip with the webs constituting the walls of the package. This inconvenience is more than compensated for by the package that is produced. The side packets are connected by a bridge comprising an array of multiple partitions spanning between the two webs to produce five separated compartments in a space no larger than a typical bridge without compartments. The same basic results are achieved as with the physical mask, but by the use of a printed pattern of resist bars on a much finer scale.

Figure 8:
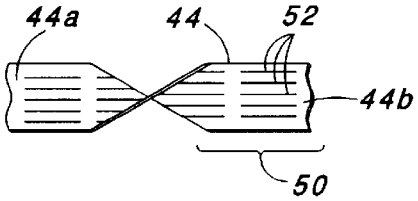
FIG. 8 is a diagrammatic partial elevation view of a twisted insert strip illustrating the printed resist bars on both sides of the strip.
Figure 9:
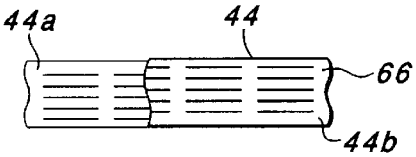
FIG. 9 is a diagrammatic fragmentary plan view, partially cut away, illustrating the registry of the printed resist bars on opposite sides of the insert strip.

One example of the printed technique is shown in FIG. 8, where the pattern 50 of resist bars 52 is printed on both sides 44*a* and 44*b* of the thin strip 44, with one side being out of register with the other. The pattern is identical on both sides except for an 180°, or half-pitch, offset from one side to the other. The result of this technique is the bridge 54 shown in FIG. 6. Because, unlike the physical mask, the resist bands may laterally overlap, where they do overlap the sheet material of the strip bonds to neither of the side webs, so that angular partitions 50 are of substantial width, spanning between the webs with the consecutive webs being separated by short welds 52. The ratio of the size of the transverse partitions to the width of the welds is roughly reversed in this embodiment from that of the first embodiment using the physical mask, as can be appreciated by comparing FIGS. 4 and 6. Weld widths are limited on the lower end by the required ⅛ inch widths of the tines.

Figure 6:
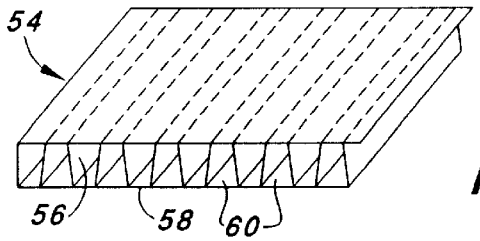
FIG. 6 is a diagrammatic perspective view of a bridge formed by a sequence of the internal partitions as it would appear when using the printed mask block technique of FIGS. 8 through 11.

As shown in FIG. 6, multiple compartments 54 created by the partitions and webs, with relatively wide spacing between the webs and narrow welds. The more compartments, the longer it will take the substance from one packet to migrate into the other packet, and a quarter-inch run of five consecutive compartments should keep most substances separated for years, if not in perpetuity.

It will be obvious to anyone skilled in the art that the compartmented barrier could be made by printing on the package webs rather than the center strip. In the same way, the mask could be printed on one surface of the thermoplastic strip and one surface of the package wall. The simplest version of all would have a single block of resist printed on one of the four possible surfaces. The version thus produced would be have single flat compartment, and would not possess the advantages of the high barrier multiple-weld multiple-compartment configuration described above.

Figure 10:
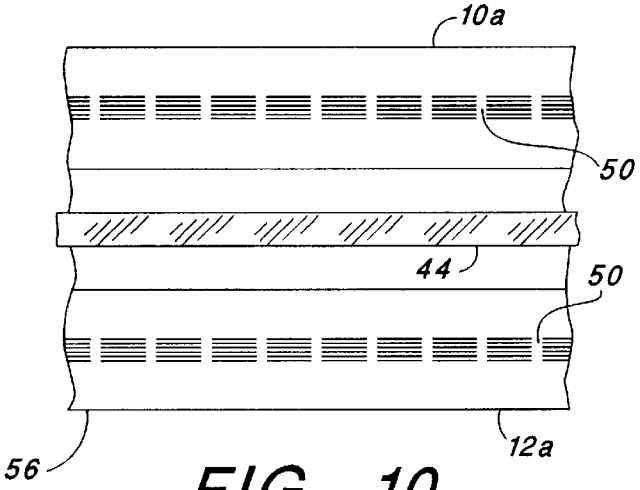
FIG. 10 is a fragmentary elevation view of a pair of separate webs each having resist bars printed thereon with the blank center strip illustrated between the two webs.
Figure 11:
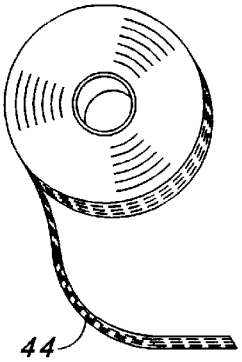
FIG. 11 is a perspective view of a typical reel of the resist strip illustrated in FIG. 8.

As shown in FIG. 10, the two pre-printed patterns 50 on the webs 10(*a*) and 12(*a*), which in this illustration are the two halves of a single sheet 56, are folded over into overlaid position. The patterns are printed to result in their being 180° out of phase with one another longitudinally, and the strip 44 is fed through the two parts of the mask and between the two wall webs as all of them feed into the packaging machine. The result is equivalent or identical to the result of the first-described sequence using the double-printed strip. The strip, which required registration when it bore the printed mask bars, no longer is in need of this step since there is nothing on it to register. The strip needs no run-time registry when the resist is on the webs.

Although described thus far as the barrier weld between compartments, the same processes could be used in a peripheral weld where a predetermined opening point is planned into the package, as in shampoo samples wherein a chevron or delta-shaped area is printed on the packet to identify the burst zone.

Figure 12:
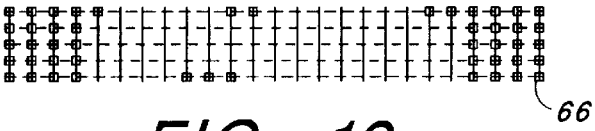
FIG. 12 is a plan view of a resist bar printed as a series of dots.
Figure 13:
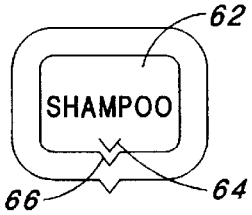
FIG. 13 illustrates a single-compartment package with a peripheral breakaway zone.

Experimentation has shown that the performance of the printed mask can be enhanced by producing a feathering effect at the ends of the printed bars that are to be subsequently crossed by the transverse heat seal. As shown in FIG. 12, one suitable feathering technique is to print the mask as a series of dots 60, with the dots being of reduced diameters but on the same pitch starting several dots from the ends of the pattern. Another advantage of the resist being printed in this way is that it provides tiny sites between adjacent resist dots where tack welds are made. These many tack welds maintain the close proximity between the thermoplastic strip and the outer package wall when the package is handled prior to activation but do not add substantially to the required rupturing force. This helps prevent the premature failure of the thermoplastic strip due to mechanical failure.

These methods, advancing on the progress of prior innovations, make possible the manufacture of mixing bags that are not only superior in shelf life and use, but in many cases are less expensive to make as well, for an unusual simultaneous improvement in both of two characteristics that are generally mutual trade-offs. With no trade-off penalty, ready acceptance in the industry is likely.

I claim:

1. A method of creating a frangible internal barrier in a bridge defined between left and right packets defined in a substantially endless series between front and back package webs, using a packaging machine which defines a feed direction, a longitudinal direction being defined as said feed direction, and said machine including a welder for receiving two package webs fed therethrough in said feed direction to form, at a longitudinally established welding situs in said machine, a substantially continuous longitudinal welded band separating the respective left and right packets and defining a bridge therebetween, said method comprising the following steps:

(a) inserting a longitudinally extended comb mask having a plurality of tines into said welder in the feed direction at least as far as said welding situs and being laterally positioned to lie at least partially in registry with said welded band, such that in operation, as said packaging machine feeds said two package webs into said welder, said welder is prevented from welding together said two package webs on immediate opposite sides of said tines due to their presence;

(b) feeding a longitudinally extended thermoplastic strip between said webs and interweaving same between the tines of said mask, such that said strip is alternately welded to one of said webs but is blocked from the other of said webs in the region registering with said mask such that continuous separable regions are defined between said strip and alternating ones of said webs where said tines were effectively withdrawn and said strip is pleated to form at least one interweb partition comprising said barrier.

2. A method according to claim 1 wherein said packaging machine includes a lateral periodic welder that welds said together periodically to form closed tops and bottoms of packages produced by said machine, and including operating said machine to run said lateral periodic welder in complete disregard to the longitudinal positioning of said strip relative to any other structure of said machine or to any other material used in fabrication of said packages.

3. A method according to claim 1 wherein said comb mask has at least three tines and step (b) includes weaving said strip in and out of said tines such that said strip welds alternately between said webs in a pleated configuration defining a plurality of separable regions, at least one of which is a closed-sided vacant compartment.

4. A method according to claim 1 wherein said left and right packets are to be produced in finished product form as joined packet pairs containing separated substances which are later combined by rupturing the internal barrier of said bridge, and including the preliminary step of selecting a thermoplastic strip having characteristics of chemical resistivity and permeability compatible with the task of substantially maximizing the time required for said substances to permeate through said barrier in mutual approachment prior to rupturing said barrier in planned use.

5. A method according to claim 1 wherein said left and right packets are to be produced in finished product form as joined packet pairs containing separated medicinal substances which are to be later combined by rupturing the internal barrier of said bridge, and including the preliminary step of selecting a thermoplastic strip having the characteristic of being free from chemically active and potentially contaminating mask substances.

6. A method according to claim 1 wherein said welder has at least one heating head and including the preliminary step of modifying said heating head to produce relieved surface regions corresponding to the areas of said head that register with spaces between the tines of said mask as said welded band is produced.

7. A method of creating a barrier bridge between individual packets of a multiple packet package made from two superimposed thermoplastic webs sealed together to form an envelope, said method being for use in a packaging machine which also defines a welder for making a continuous longitudinal weld band across a central portion of said envelope to separate the envelope into separate left and right packets, said method comprising the following steps:

(a) introducing a thermoplastic partition strip, having a substantially stable and known tear strength substantially less than that of said webs, between said webs in registry with said welder to register with and partially define said weld band;

(b) welding said strip to both of said webs in offset weld lines defining at least one partition to seal off the respective left and right sides of said envelope into separate compartments such that the force required to rupture said at least one partition is the force required to put said packets into communication and can be controlled substantially accurately by selecting the material of said strip.

8. A method according to claim 7 wherein said partition strip is only of that width necessary to define said at least one partition such that a minimum of strip material is used, enabling the selection of strip materials to include relatively expensive coextruded sheets and specialty films without rendering packages produced therefrom commercially unfeasible.

9. A method according to claim 8 wherein said partitions are plural and define a plurality of vacant parallel compartments therebetween to act as sequential multiple barriers to substances trying to breach said barrier bridge.

10. A method according to claim 9 wherein said webs are pre-coated with a respective resist pattern of longitudinally extended stripes which, when registered with the stripes of the other web at said weld band, partially overlap same, such that the weld pattern produced in said strip comprises, in laterally progressive sequence, free-sided partitions with both sides of said strip free, a weld line bonding said strip to a first one of said webs, another free-sided partition, a weld line bonding said strip to the other of said webs, and repeating for the desired number of sequences in said lateral progressive sequence.

11. A method according to claim 9 wherein said partition strip is printed on both sides with resist stripes which overlap to produce a pleated partition strip which zig-zags between said webs to define a plurality of parallel vacant compartments.

12. A method according to claim 11 wherein said stripes overlap on the order of 75%, with the overlapped portions representing those portions of said strip which weld to neither of said webs and are thus free-sided partitions.

13. A method according to claim 7 wherein said stripes comprise bars of printed dots.

14. A method according to claim 13 wherein said dots are of a certain pitch and the dots of said bars within a predetermined distance from the ends of said bars are decremental in size but retain said certain pitch progressively in the longitudinal direction toward the ends to produce a feathering effect.

15. A method of making compartmented envelopes with a frangible longitudinal partition on a packaging machine by providing a frangible longitudinal partition web with offset bond lines, said method comprising the following steps:

(a) providing a pair of webs being similar in shape and dimension and being overlaid and mutually bonded to form an envelope with a sealed internal compartment;

(b) inserting a band between the webs, the band extending across the envelope; and (c) bonding the band to the webs with offset bond lines, the band forming a pleated partition zig-zagging between the alternating bond lines forming a frangible longitudinal partition dividing the envelope into multiple containment packets.

16. A method of claim 15 wherein multiple bonding of the band to the webs form a plurality of parallel adjacent vacant compartments separating the containment packets.

* * * * *